United States Patent [19]

Huczek

[11] 4,183,438

[45] Jan. 15, 1980

[54] SHELF DIVIDER

[75] Inventor: Richard Huczek, Toronto, Canada

[73] Assignee: Loblawscompanies Limited, Toronto, Canada

[21] Appl. No.: 848,002

[22] Filed: Nov. 3, 1977

[51] Int. Cl.[2] ..... A47F 1/00

[52] U.S. Cl. ..... 211/49 D; 211/128; 211/184

[58] Field of Search ..... 108/59–61; 211/42, 43, 49 D, 183, 184, 55, 128; 312/140–140.3

[56] References Cited

U.S. PATENT DOCUMENTS

| | | | |
|---|---|---|---|
| 302,624 | 7/1884 | Dickinson | 211/184 |
| 1,317,589 | 9/1919 | Noziska | 211/184 |
| 1,911,368 | 5/1933 | Kress | 211/128 X |
| 2,123,264 | 7/1938 | Walter | 312/140.3 |
| 2,631,916 | 3/1953 | Bjoro et al. | 312/140.3 X |
| 2,658,628 | 11/1953 | Hilgen | 211/184 |
| 2,855,258 | 10/1958 | Moncier | 211/184 X |

FOREIGN PATENT DOCUMENTS

| | | | |
|---|---|---|---|
| 1524249 | 4/1968 | France | 211/184 |

*Primary Examiner*—Roy D. Frazier

*Attorney, Agent, or Firm*—Rogers, Bereskin & Parr

[57] ABSTRACT

A shelving system for parallel sloping shelves in which each shelf is of greater depth than the shelf above it, and having transparent divider units located in pairs on the shelves. Each divider unit has a longitudinal upright divider member extending over a substantial portion of the depth of, and at least 75 percent of the height of, its shelf; a slide member extending the full length of the divider member and connected to the bottom of the divider member and extending at right angles thereto; and a stop member of the same height as the divider member. The stop member is connected to the front edges of the divider and slide members and extends at right angles to each. The pairs of divider units on the shelves have their stop members facing each other but with a gap therebetween, so that a shelf user can insert his hand through the gap to lift an article from or replace an article on the shelves.

1 Claim, 8 Drawing Figures

SHELF DIVIDER

This invention relates to a novel divider unit for shelves, and to a shelving system which incorporates the novel divider units.

Proper display on shelves of articles to be sold has long been a problem in supermarkets. One of the problems which has existed with horizontal shelving is that when a customer removes the front article on a shelf, the article behind it is less clearly displayed to following customers, i.e. it is located in a recessive position. This is highly undesirable from a merchandising point of view.

In an attempt to deal with this problem, some supermarkets have adopted angled shelving, in which when the front article is removed, the article behind it will slide downwardly to reoccupy the front position. However, this system has required a front "fence" extending along the shelf, and the fence has had to be of limited height, since otherwise it interferred with removal of articles from the shelves. This limited the height to which articles could be piled on the shelves and often resulted in inefficient use of shelf space where some of the articles on the shelf were high and others were low.

A further difficulty which has occurred, particularly with angled shelving, is that there is little or nothing retaining the articles in an organized fashion on the shelves. It has been noticed that when articles become placed on a shelf in a disorganized manner, customers who then remove an article from the shelf for a closer look will tend to replace the article in a careless manner. The result is that the articles on the shelf tend to become jumbled, which again is undesirable from a merchandising point of view. Substantial expensive labour is required to maintain the articles properly organized on the shelves, and this increases the cost of the merchandising operation and hence the cost to the consumer.

Accordingly, it is an object of the present invention to provide a novel divider unit, and a shelving system incorporating the divider unit, which permits improved organization of articles on shelves. In a preferred embodiment, the invention provides a divider unit having a longitudinal upright divider member, a slide member extending the full length of the divider member, the slide member being connected to the bottom of the divider member and extending at right angles thereto, and a stop member of height substantially the same as that of the divider member, the stop member being connected to the front of the divider member and to the front of the slide member and extending at right angles to each. The distance by which the stop member projects laterally from the divider member is between 1¼ inches and two inches. The stop member is formed of material which permits a substantially unobstructed view therethrough (e.g. transparent plastic), and means are provided for securing the unit to a shelf. In use, the divider units are arranged in pairs on a shelf, with their divider members extending over a substantial portion of the depth of the shelves, and the height of the stop members being at least equal to 75 percent of the distance between the shelves (measured in a direction at right angles to the plane of the shelves). The stop members of the respective divider units are arranged to face each other but with an upright gap therebetween, so that a customer can insert his hand through the gap to lift an article from the shelves.

Further objects and advantages of the invention will appear from the following description, taken together with the accompanying drawings, in which.

Figure 1:
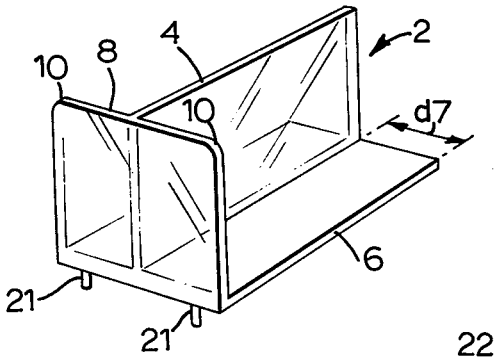
FIG. 1 is a perspective view showing a novel divider unit according to the invention.

Reference is first made to FIG. 1, which shows a divider unit generally indicated at 2 and formed of a transparent plastic material. The divider unit 2 includes a longitudinal upright divider member 4 extending the full length of the divider unit. Connected to the bottom of the divider member 4 is a slide member 6, which extends at right angles to the plane of the divider member 4 and which projects equally on each side of the divider member 4.

At the front of the divider unit 2 there is located a stop member 8. The stop member 8 is connected to the front edges of both the divider member 4 and the slide member 6 and extends at right angles to each of these members. The outer top corners of the stop member 8 are rounded as indicated at 10, to reduce the likelihood of their catching on a customer's hand or on an article being removed from the shelves, as will be explained.

Figure 3:
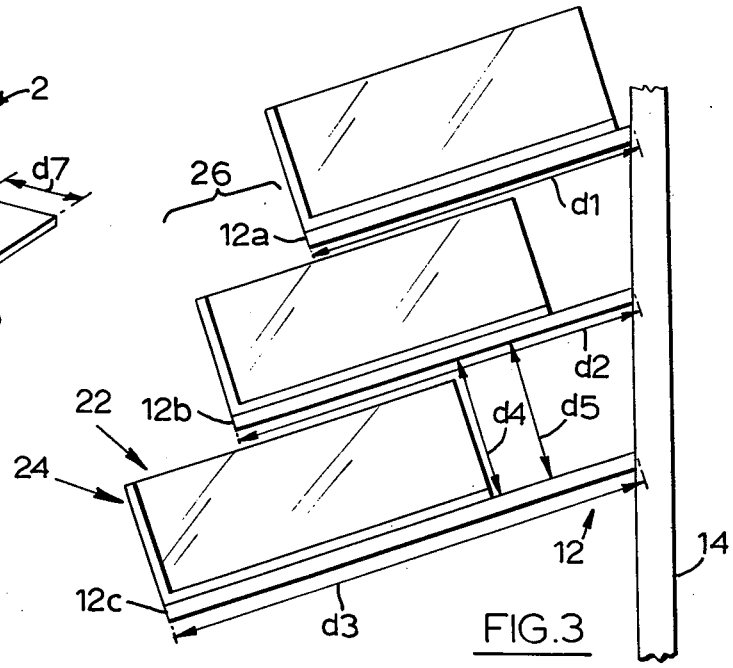
FIG. 3 is a side view of shelving showing divider units of the invention in place thereon.
Figure 2:
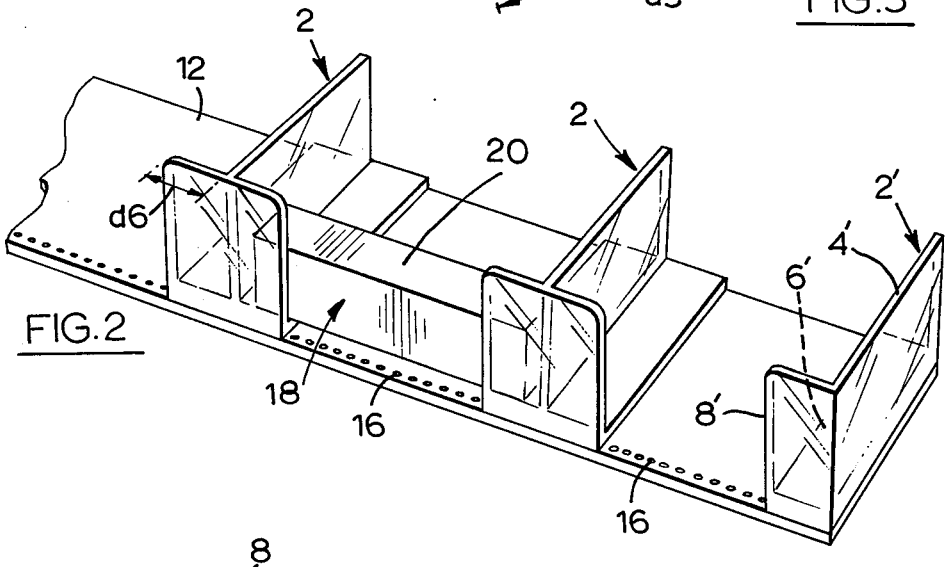
FIG. 2 is a perspective view showing divider units of the invention arranged on a shelf.

The divider units 2 are intended to co-operate with shelves 12 of the kind shown in FIGS. 2 and 3. The shelves 12 are conventional and consist of a number of parallel downwardly and outwardly sloping shelves **12*a*, 12*b*, 12*c*, supported by a vertical shelf support 14. As is conventional, each shelf is of greater depth than the shelf above it. In other words, the depth d1 of shelf 12*a* exceeds depth d2 of shelf 12*b*, and depth d2 exceeds depth d3 of shelf 12*c*. The front edges of the shelves 12*a*, 12*b*, 12*c* each contains a row of small holes 16**, which are normally intended to receive the posts of wire fencing.

The divider units 2 are placed on the shelves 12 with the divider members 4 extending depth wise of the shelves. The divider members 4 are dimensioned so that they normally extend over a substantial portion of the depth of the shelves, as indicated in FIG. 3. In FIG. 3 the divider unit 2 on the shortest shelf **12*a* extends the full depth of shelf 12*a*. Since shelves 12*b* and 12*c* are deeper than shelf 12*a*, the divider units 2 on these lower shelves do not extend the full depth of the shelves but do extend over at least half, and preferably at least two-thirds, of the depth of these shelves. If desired, divider units 2** can be made in different lengths to accommodate different depth shelves, but it is desirable to keep the variations in the divider units to a minimum, to reduce stocking and handling labour.

The height d4 of the divider members 4 (measured from the bottom to the top of the unit 2) is normally made equal or nearly equal to the distance d5 (FIG. 3) between adjacent shelves, measured in a direction perpendicular to the plane of the shelves 12. Preferably the height d4 of the divider members is between 75 and 100 percent of dimension d5. This enables articles to be stacked to nearly the full height of each shelf.

As shown in FIG. 2, the divider units 2 are positioned on the shelves with a gap 18 between their stop members 8. The distance between adjacent divider members 4 is normally made sufficient to accommodate the width of the particular type of article to be located between the two divider units in question, with a slight clearance. A typical such article is indicated at 20 in FIGS. 2 and 3. Different width articles may be accommodated by placing the divider units 2 at different spacings along the shelves. The divider units 2 are secured to the shelves 12 by plastic pegs 21 molded integrally with the divider units and projecting downwardly from the bottom edges of the stop members 8. The pegs 21 fit into the holes 16 in the fronts of the shelves.

In use, a customer can readily see articles on the shelves 12, both by looking at the top of the article, which is visible along the line of sight indicated by arrow 22 in FIG. 3, and by looking through the stop members 8 along the line of sight indicated by arrow 24 in FIG. 3. Because the divider units are of transparent material, they permit substantially unobstructed view of articles placed behind the stop members 8.

To remove an article from the shelves 12, or to replace the article, the customer simply extends his hand through the gap 18 between the stop members 8 to grasp the article. Because the gap 18 extends the full height of the divider units, the customer is readily able to extend his hand through the gap 18 to grasp an article on any shelf. The article is lifted out through the gap 26 (FIG. 3) between the stop member 8 and the shelf above the shelf in which the article is located. Replacement of articles on the shelf in an orderly manner is facilitated, because the spacing between the divider members 4 is equal to the width of the articles in question plus a slight clearance, so that it would be difficult for the customer to replace an article in anything but an orderly manner. In addition, because removal of an article leaves the remaining articles orderly, the customer is less likely to see jumbled articles on the shelf which may tempt him to replace an article in a hap-hazard manner.

The projection of each stop member 8 laterally to one side of its associated divider member 4, as indicated by dimension d6 in FIG. 2, is important but may vary depending of the type of articles to be displayed. For flexible packages, such as packages of plastic garbage bags, marshmallow packages or the like, a preferred value for dimension d6 is about 1¼ inches. Dimension d6 will not normally be less than about one inch for deformable packages, since otherwise the packages can deform and slip through the gap 20. Dimension d6 could be as much as about 2 inches, but if dimension d6 is too large, than gap 20 will be too small for a customer to extend his hand therethrough unless the article to be placed on the shelf is quite large. For most articles, 2 inches is a practical upper limit for dimension d6. For hard packages, dimension d6 can be quite small, but should be at least one quarter inch.

The lateral projection of the slide member 6, indicated by dimension d7 in FIG. 1, will normally be the same as the lateral projection d6 of each stop member. However, the lateral dimensions d7 of the slide members 6 may be varied if desired. The major function of the slide member 6 is to strengthen the unit by preventing sideways wobble of the divider member 6. However, the lateral projection of the divider member 6 should be sufficient so that articles can slide easily thereon, and for this reason the lateral projection d7 of each slide member 6 will normally be made approximately the same as that of the stop members 8.

If desired, the divider units 2 may be modified as shown at 2′ in FIG. 2. The divider unit 2′ is the same as divider unit 2, except that its stop member 8′ and slider member 6′ extend only on one side of the divider member 4′. The divider unit 2′ is particularly suited for the ends of shelves, where on sided units only are required. Left and right hand versions of divider unit 2′ may be provided.

Figure 4:
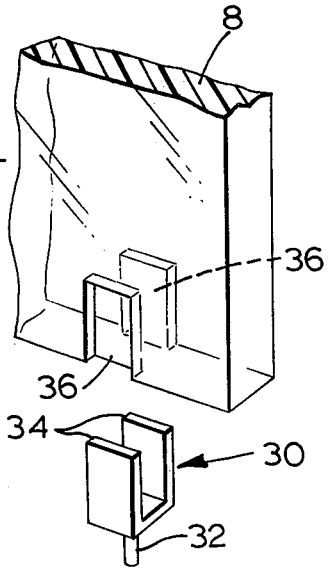
FIG. 4 is a perspective view showing an alternative means for securing a divider unit of the invention to a shelf.

It will be appreciated that various means may be used to secure the divider units 2 to the shelves. For example, instead of the pegs 21, separate metal clips 30 (FIG. 4) may be used, having a stem 32 to plug into the holes 16, and a pair of flat metal forks 34. The forks 34 can be spread slightly and slide into matching recesses 36 formed in the bottom portions of the stop members 8. The forks 34 grip the stop members by friction and the recesses 36 not only prevent movement of the clips 30 but also ensure that the forks 34 are recessed so that they will not interfere with movement of articles or customers therepast.

Figure 5:
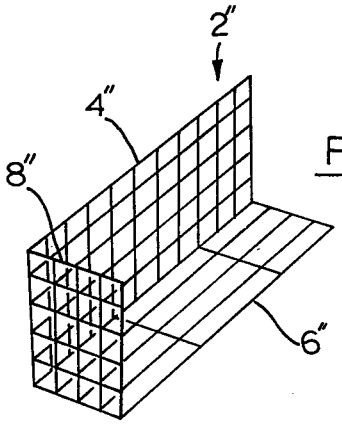
FIG. 5 is a perspective view showing a modification of the divider unit of FIG. 1.

The divider units 2 may if desired be formed of wire, in the same manner as wire fences, instead of being formed of solid transparent material. Such an arrangement is shown in FIG. 5 where double primed reference numerals indicate parts corresponding to those of FIGS. 1 to 3. However, the use of a solid material is preferred, since it facilitates sliding of the articles in question along the slide members 6, and since unless relatively heavy and hence unsightly wire is used, divider units made of solid transparent material will usually provide a stronger system.

Figure 6:
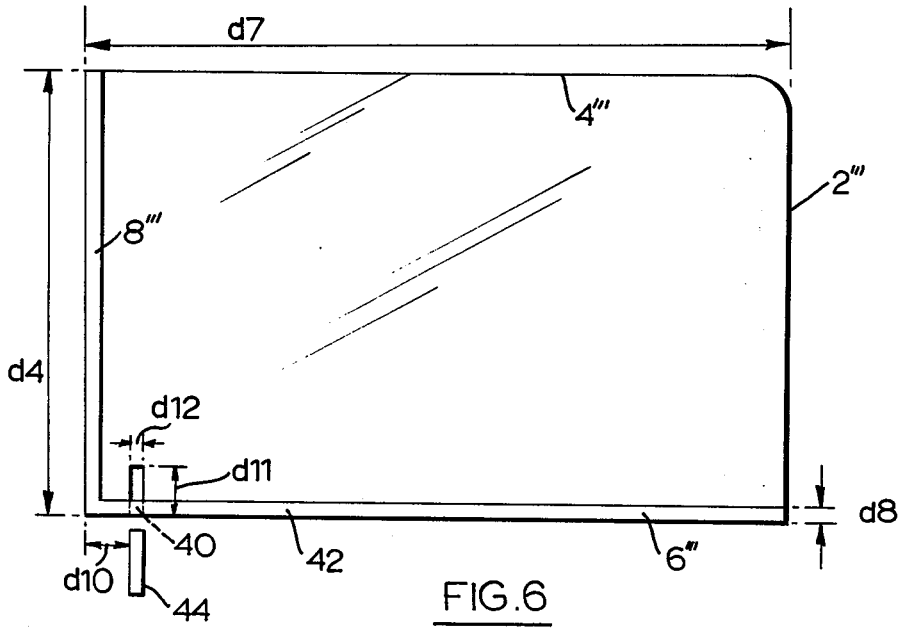
FIG. 6 is a side view showing another divider unit according to the invention.
Figure 7:
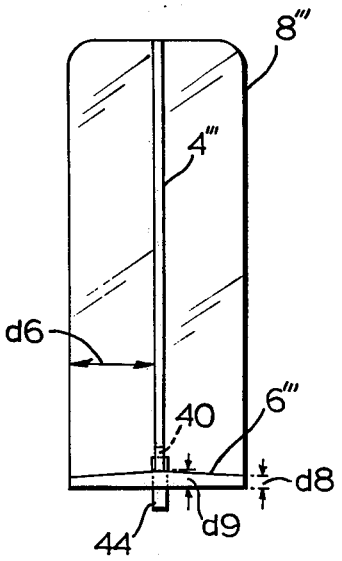
FIG. 7 is a rear view of the divider unit of FIG. 6.
Figure 8:
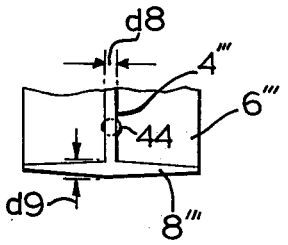
FIG. 8 is a top view of a part of the divider unit of FIG. 6.

Finally, reference is made to FIGS. 6 to 8, which show a slightly modified divider unit according to the invention. In the FIGS. 6 to 8 unit, triple primed reference numerals indicate parts corresponding to those of FIGS. 1 to 4.

The divider unit 2‴ of FIGS. 6 to 8 is formed of clear plastic, injection molded, and has a small hole 40 formed in its lower surface 42. The hole 40 extends up into the divider member 4‴ and as shown is of diameter greater than the thickness of the divider member 4‴. A friction fit clear plastic plug 44 is supplied with the unit, and when the shelf on which the unit is to be placed has perforations, then the plug 44 is forced into the hole 40. The bottom of the plug 44 then projects below the divider unit and anchors the front of the unit to the shelf. When the plug is not used, a button of two sided adhesive tape may be used instead. The rear of the unit normally does not need separate anchoring since it normally is held in place by the product located on the unit.

As shown in FIG. 7, the slide members 6‴ taper slightly in thickness from their inner to their outer edges. This helps to stiffen the unit while using less plastic, and also reduces the height of the discontinuity between the upper surface of the shelf and the upper surface at the edges of the slide members. As shown in FIG. 8, a similar taper occurs in the stop members 8‴, for strengthening purposes.

Typical dimensions for the divider unit 2‴ are as follows (the dimensions given are approximate):

| | | inches |
|---|---|---|
| d4 | (height of unit) | 7 1/2 |

-continued

| | | inches |
|---|---|---|
| d6 | (lateral extent of stop member 8''' and of slide member 6''') | 1 7/16 |
| d7 | (depth of unit) | 12 |
| d8 | (thickness of free edges of unit) | 3/32 |
| d9 | (thickness of material at junction of slide and stop members) | 5/32 |
| d10 | (spacing of hole 40 from front of unit) | 5/8 |
| d11 | (height of hole 40) | 15/32 |
| d12 | (diameter of hole 40) | 7/32 |
| d13 | (projection of inserted plug 44 below bottom of unit) | 1/4 |

What I claim as my invention is:

1. A shelving system comprising:

(a) a shelf support and at least two parallel shelves sloping downwardly and outwardly therefrom, one of said shelves being located above and adjacent the other, the upper shelf being of a first predetermined depth and the lower shelf being of a second and greater predetermined depth, the distance between said shelves measured in a direction perpendicular to the plan of said shelves being a predetermined distance, (b) a pair of divider units for said lower shelf, each divider unit comprising:

(i) a longitudinal upright divider member of length equal to a substantial portion of said second predetermined depth, (ii) a slide member connected to the bottom of said divider member and extending at right angles thereto, said slide member extending the full length of said divider member and projecting equally on each side of said divider member and having two longitudinal edges, one on each side of said divider member, said slide member tapering in thickness from said divider member towards each said edge, (iii) a stop member of height substantially the same as that of said divider member, said stop member being connected to the front of said divider member and to the front of said slide member and extending at right angles to each on each side of said divider member, to the same extent as said slide member, (iv) the height of said divider member and stop member being at least equal to 75 percent of said predetermined distance, and the distance by which each stop member projects laterally from its associated divider member being between ¼ inch and two inches, (v) said stop member, divider member and slide member being an integral unit formed of transparent plastic, (vi) each divider member having a vertical hole therein, said hole extending from the bottom of said divider member upwardly above the level of the top of said slide member and being of diameter greater than the thickness of said divider member, said hole being located a short distance rearwardly of said stop member, (c) fastening means securing said divider units to said lower shelf with the respective stop members of said divider units being directed toward each other and with an upright gap of substantial width between said respective stop members, so that a hand may be inserted therethrough to place articles on said lower shelf between said divider members or to remove articles from said shelf from between said divider members, (d) said fastening means including a transparent plastic peg removably friction fitted into said hole in each divider member and projecting downwardly below each divider member, said shelves having shelf holes spaced along the front thereof and said pegs being inserted into said shelf holes.

* * * * *